US007422190B2

(12) United States Patent
Messein et al.

(10) Patent No.: US 7,422,190 B2
(45) Date of Patent: Sep. 9, 2008

(54) DEVICE FOR DAMPING THE VIBRATIONS OF A CABLE AND RELATED DAMPING METHOD

(75) Inventors: Jean-Pierre Messein, Villers-les-Nancy (FR); Benoit Lecinq, Fontenay-Aux-Roses (FR)

(73) Assignee: Freyssinet International (STUP) (FR)

( * ) Notice: Subject to any disclaimer, the term of this patent is extended or adjusted under 35 U.S.C. 154(b) by 159 days.

(21) Appl. No.: 10/930,269

(22) Filed: Aug. 31, 2004

(65) Prior Publication Data

US 2005/0072895 A1 Apr. 7, 2005

(30) Foreign Application Priority Data

Sep. 3, 2003 (FR) ..... 03 10420

(51) Int. Cl.
*F16M 13/00* (2006.01)

(52) U.S. Cl. ..... 248/636

(58) Field of Classification Search ..... 248/636, 248/562, 564, 570, 638, 68.1; 14/18, 22, 14/23, 73.5, 78; 267/136, 141; 188/378; 174/42

See application file for complete search history.

(56) References Cited

U.S. PATENT DOCUMENTS 4,995,583 A 2/1991 De la Fuente
5,857,712 A * 1/1999 Kato ..... 285/49
6,292,967 B1 * 9/2001 Tabatabai et al. ..... 14/22
6,334,608 B1 1/2002 Stubler
6,578,328 B2 * 6/2003 Bournand et al. ..... 52/223.13
2004/0128776 A1 * 7/2004 Eicher

FOREIGN PATENT DOCUMENTS

| | | |
|---|---|---|
| EP | 1 035 350 | 9/2000 |
| GB | 1 529 171 | 10/1978 |
| JP | 06058369 | 1/1994 |
| NL | 8 700 589 | 10/1988 |

OTHER PUBLICATIONS

Patent Abstracts of Japan, vol. 18, No. 297 (M-1617), Jun. 7, 1994; JP 06 058370 A (Mitsubishi Heavy Ind. Ltd). Mar. 1, 1994, (Abstract; Figures 1-4).
Patent Abstracts of Japan, vol. 1997, No. 7, Jul. 31, 1997; JP 09 059921 A (Kajima Corp.), Mar. 4, 1997, (Abstract; Figures 1-3).

(Continued)

*Primary Examiner*—Gwendolyn Baxter
(74) *Attorney, Agent, or Firm*—Banner & Witcoff, Ltd.

(57) ABSTRACT

The invention proposes a device for damping the vibrations of a cable used in the structure of a construction work, the cable comprising a bundle of metal strands having ends anchored to the work and being surrounded, in at least one region adjacent to an anchored end of the bundle, by a tube connected to the work, the device comprising a collar placed around the bundle of strands and means of absorbing the vibration energy mounted substantially between the collar and the tube, wherein the absorption means comprise at least two piston-type dampers with substantially linear stroke, placed substantially radially relative to the cable and distributed at angles around the cable, each piston-type damper having a first link articulated with the collar and a second link articulated with a support secured to the tube.

20 Claims, 5 Drawing Sheets

OTHER PUBLICATIONS

Patent Abstracts of Japan, vol. 1997, No. 2, Feb. 28, 1997; JP 08 277874 A (Ishikawajima Harima Heavy Ind. Co. Ltd.), Oct. 22, 1996, (Abstract; Figures 1-5).

Patent Abstracts of Japan, vol. 1999, No. 11, Sep. 30, 1999; JP 11 172618A (Kajima Corp.), Jun. 29, 1999 (Abstract; Figures 1-4).

French Preliminary Search Report.

* cited by examiner

DEVICE FOR DAMPING THE VIBRATIONS OF A CABLE AND RELATED DAMPING METHOD

CROSS REFERENCE TO RELATED APPLICATION

This application is a utility application based on Patent Application No. FR 03 10420 entitled "Device for Damping the Vibrations of a Cable and Related Damping Method" filed Sep. 3, 2003 for which priority is claimed.

BACKGROUND OF THE INVENTION

The present invention relates to devices for damping the vibrations of a cable used in the structure of a construction work, in particular a stay.

The invention applies in particular to stayed bridges. The stays are then anchored at their ends, for example to a tower and to the deck of the bridge. They thus support and stabilize the structure.

In some conditions, particularly when they are subject to periodic excitations, the stays may accumulate energy and oscillate considerably. The two primary causes of these vibrations are the movement of the anchorages under the effect of traffic loads or of the wind, and the effect of the wind acting directly on the cables. These oscillations may make the users anxious. In addition, if they are not controlled, they risk damaging the stays.

Several types of dampers are known. There are external dampers and internal dampers.

External dampers usually use piston-type dampers, of dimensions similar to those used for lorries or trains. These dampers are able to absorb energy when there is movement of their ends. One of these ends is attached to the cable, either directly via a collar, or via a pendulum in turn articulated on a collar attached to the cable. The other end of the damper is attached to a frame rigidly connected to the structure, usually the deck of the stayed bridge.

Internal dampers, for their part, are placed around the stay cable. They are usually situated in the extension of the tubes surrounding the bundle of metal strands making up the cable and attached rigidly to the structure (anchoring tubes for example). They act on the relative movements between the bundle of strands of the cable and the anchoring tube surrounding the bundle of strands when the cable vibrates.

Several damping principles are employed by internal dampers to dissipate energy:

/a/ by pouring a highly viscous oil into an annular trough situated around the bundle of metal strands of the cable and in which trough is mounted a ring that is transversely movable (see EP 0 343 054);

/b/ by distortion of a dissipating material, such as rubber, situated around the bundle of metal strands of the cable (see EP 0 914 521);

/c/ by dry friction between metal elements (see EP 1 035 350).

These internal dampers have the advantage of being discreet, hence more aesthetic than external dampers. The absence of anything bearing on the structure outside the anchoring tubes also simplifies the design of the work.

Nevertheless, the effectiveness of internal dampers is limited. Specifically, in the dampers operating according to principle /a/, the presence of viscous oil requires the use of sealed reservoirs of the bladder type which have limited resistance to high pressures. The dampers operating according to principle /b/ have low damping capability, limited by the performance of the materials available. Finally, in the dampers operating according to principle /c/, wearing of the contacting metal elements is inevitable and leads to loss of clamping and hence a reduction in the effectiveness of these dampers. The latter must therefore be periodically overhauled and adjusted.

One object of the present invention is to restrict the drawbacks of the existing dampers as listed above.

SUMMARY OF THE INVENTION

Thus the invention proposes a device for damping the vibrations of a cable used in the structure of a construction work, the cable comprising a bundle of metal strands having ends anchored to the work and being surrounded, in at least one region adjacent to an anchored end of the bundle, by a tube connected to the work, the device comprising a collar placed around the bundle of strands and means of absorbing the vibration energy mounted substantially between the collar and the tube. The absorption means comprise at least two piston-type dampers with substantially linear stroke, placed substantially radially relative to the cable and distributed at angles around the cable, each piston-type damper having a first link articulated with the collar and a second link articulated with a support secured to the tube.

Thus, the damping device does not bear against the structure other than via the tube thereby avoiding the drawbacks relating to the external dampers, mentioned above.

In addition, vibration energy in the bundle of metal strands is absorbed by the linear stroke of the pistons which accompany the movements of this bundle, due in particular to the articulation of the dampers on the collar and the support secured to the tube. This provides fully effective damping.

According to advantageous embodiments of the invention, that can be combined in all manners:

- the support secured to the tube is placed substantially in the extension of the tube, or is part of the said tube;
- the support secured to the tube is placed substantially in the extension of a sleeve surrounding the bundle of metal strands in a running part of the cable;
- the support secured to the tube comprises at least two portions suitable for being attached together around the bundle of metal strands, or separate;
- the absorption means comprise two piston-type dampers substantially perpendicular to each other;
- the absorption means comprise at least three piston-type dampers distributed evenly at angles around the cable;
- the first link is a ball-joint link, for at least some of the piston-type dampers;
- the second link is a ball-joint link, for at least some of the piston-type dampers;
- the second link is a pivot link parallel to the cable, for at least some of the piston-type dampers;
- at least some of the piston-type dampers extend partially beyond the support secured to the tube, and respective openings are provided in the support for access to the first link of the said piston-type dampers, articulated with the collar;
- sealing means to seal at least one space situated between the said piston-type dampers and the respective openings in the support;
- the first link articulated with the collar comprises, for at least some of the piston-type dampers, means of screwing a threaded end of the piston-type dampers into respective mounts;
- the screwing means are adjustable to adapt the position of the piston-type dampers to a centering level of the bundle of metal strands in the tube;

the first link articulated with the collar also comprises, for the said piston-type dampers, locking means suitable for preventing the threaded end of the piston-type dampers from unscrewing from the corresponding mounts;

one end of at least some of the piston-type dampers is provided with a male clevis, at least one corresponding female clevis is attached to the collar, and the first link articulated with the collar comprises, for the said piston-type dampers, means of inserting a pin into the male clevis of the piston and into the corresponding female clevis, the said means of inserting a pin being able to be actuated from outside the tube;

the device also comprises means for adjustably limiting the stroke of the pistons;

the means for limiting the stroke of the pistons comprise screws suitable for being screwed into or out of welded elements distributed over a surface of the collar, the screws also comprising a head provided with a material suitable for absorbing shocks.

The invention also proposes a method of damping vibrations of a cable, in which the vibrations are damped by the device having the features mentioned above.

DESCRIPTION OF PREFERRED EMBODIMENTS

Figure 1:
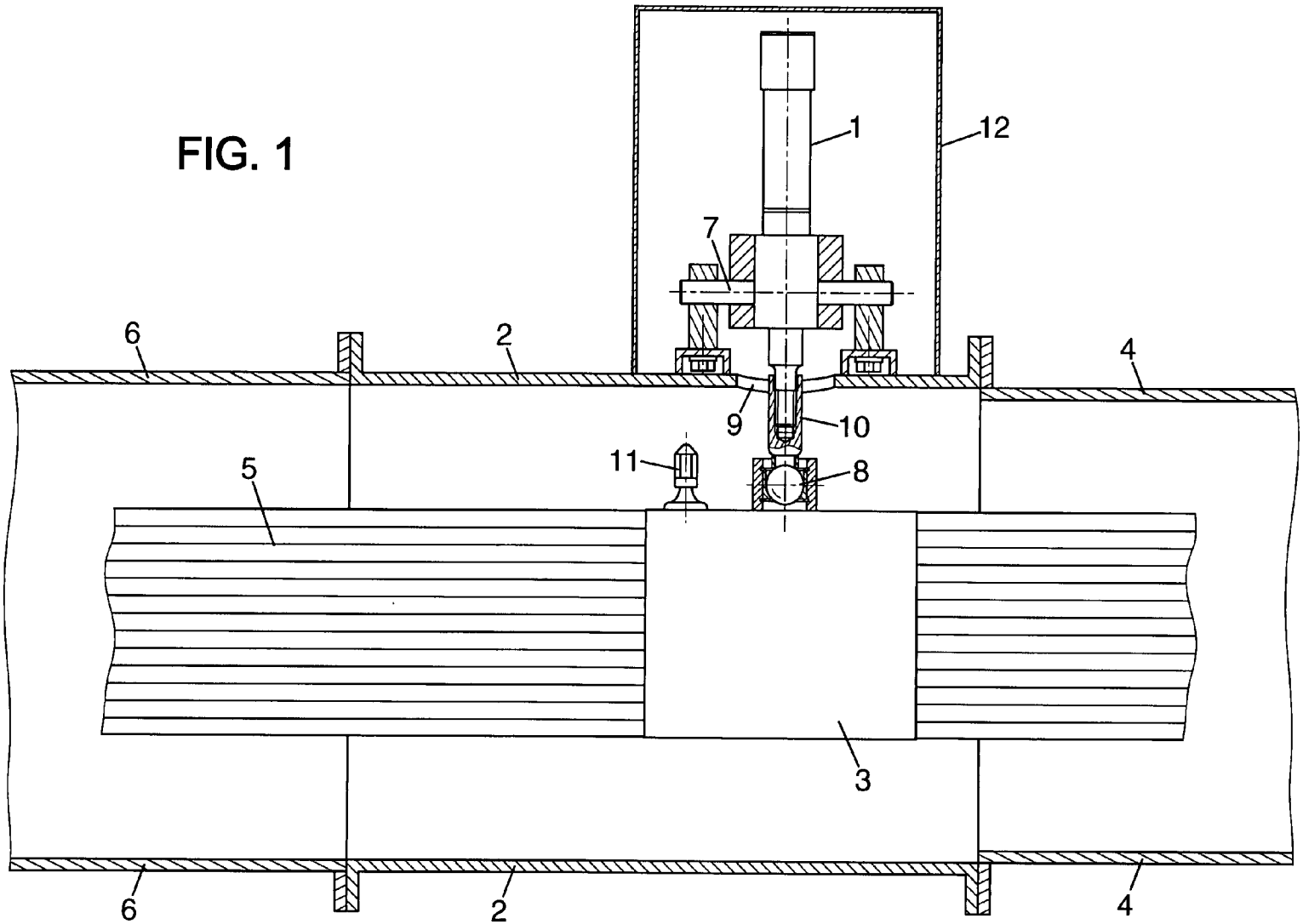
FIG. 1 is a general diagram of an embodiment of the invention in longitudinal section.

FIG. 1 shows a stay comprising a bundle of metal strands 5, surrounded in its running portion (on the left in FIG. 1) by a sheath 6, typically made of plastic. The cable also extends on the right of the figure to an anchorage region. In this region, the cable is connected to an anchoring tube 4 which is rigidly attached to the stayed structure, for example in the deck or in a tower of a cable-stayed bridge.

To limit the vibrations of the tensioned metal strands 5 of the cable, a clamping collar 3 is placed around the metal strands 5 to be able effectively to compact the bundle over a portion of the latter. This collar is preferably situated close to the anchorage region, while being sufficiently far from it to improve the damping. It may have various forms. According to one embodiment shown in FIGS. 3 and 4, it comprises an internal hexagonal surface in contact with the bundle of strands so as to clamp the bundle of strands with a minimum clearance and is made up of two distinct portions, that may be separated when there is a requirement to release the bundle of metal strands.

Furthermore, hydraulic piston-type dampers 1, the pistons having a linear stroke, are positioned radially around the bundle 5. They are connected, at one of their ends, to the cable via the clamping collar 3 (such a piston-type damper 1 is shown in FIG. 1). The piston-type dampers 1 are also indirectly connected to the work via a support, for example a shell 2 placed around the bundle of strands 5 and the clamping collar 3, while leaving a free space between its inner surface and the bundle of strands. For example, the shell 2 may have a circular cross section of the same diameter as the sheath 6 to the end of which it is connected (the left-hand end of the shell in FIG. 1). The connection between the shell 2 and the structure of the work is via the anchoring tube 4 to which the shell is connected at one of its ends (the right-hand end in FIG. 1). Accordingly, it advantageously has a circular cross section with a diameter close to that of the anchoring tube 4. This avoids the aesthetic drawbacks arising with external dampers. There is also the benefit of effective damping by the use of hydraulic dampers, the damping law of which may for example be linear, quadratic, or other.

Because of this disposition, the pistons can absorb energy during relative movements of the bundle of strands 5 with respect to the structure, thereby absorbing these movements.

Accordingly, the links between the piston-type dampers 1 and the clamping collar 3 on the one hand and the shell 2 on the other hand must offer degrees of freedom suitable for attenuating certain movements of the bundle of strands 5. Thus, the link 7 between the piston-type dampers 1 and the shell 2, and also the link 8 between the piston-type dampers 1 and the clamping collar 3 are advantageously ball-joint links. This then results in each piston-type damper operating like a connecting rod.

However, the relative movements of the cable and the shell 2 very slightly bring into play the translation in the axis of the cable, since the damper is close to the anchorage region.

Therefore a ball-joint link can also be used for the link 8 between the piston-type dampers I and the clamping collar 3, and a simple pivot link, parallel to the axis of the cable, for the link 7 between the piston-type dampers 1 and the shell 2 as shown in the figures. In this case, it would be wise to provide means of adjusting the initial position of the piston-type dampers 1 along the axis of the cable, for example by a few millimetres, to adapt it to the longitudinal position of the clamping collar 3 on the cable. The pivot and ball-joint links are provided by sturdy, durable mechanical components of the ball-joint antifriction bearing or self-lubricating bearing type.

Figure 6:
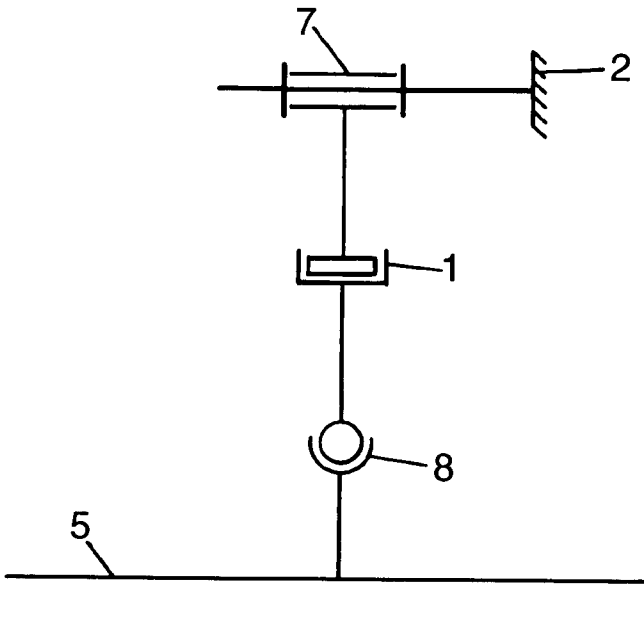
FIG. 6 is a kinematic schematic diagram of one embodiment of the invention in longitudinal view.
Figure 7:
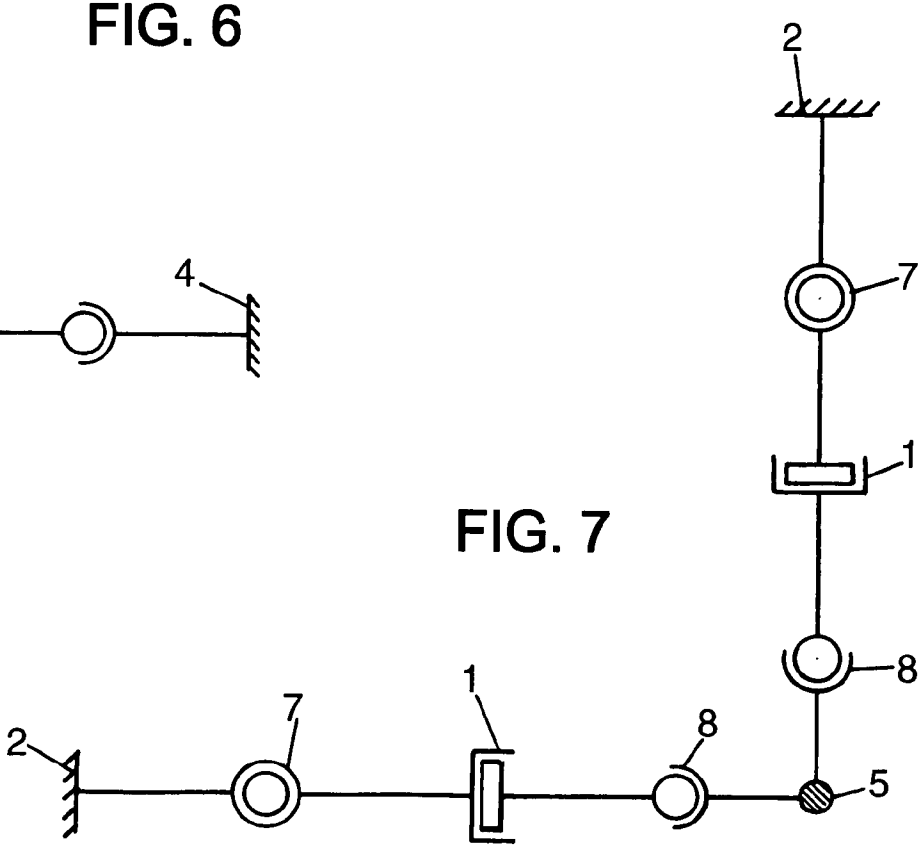
FIG. 7 is a kinematic schematic diagram of one embodiment of the invention in radial section.

FIGS. 6 and 7 are kinematic schematic diagrams of this embodiment of the invention in which the pivot link 7 between each piston-type damper 1 and the shell 2 and the ball-joint link 8 between each piston-type damper 1 and the bundle of metal strands 5 (via the clamping collar 3) can be clearly seen.

To be able to damp the vibrations of the cable in the maximum possible directions, it is advisable to position at least two piston-type dampers 1 radially around the cable. If only two piston-type dampers are used, they should preferably be placed perpendicular to each other in order to damp the vibrations in all directions, each direction then being broken down into two perpendicular components according to the directions of the two piston-type dampers being used.

Figure 5:
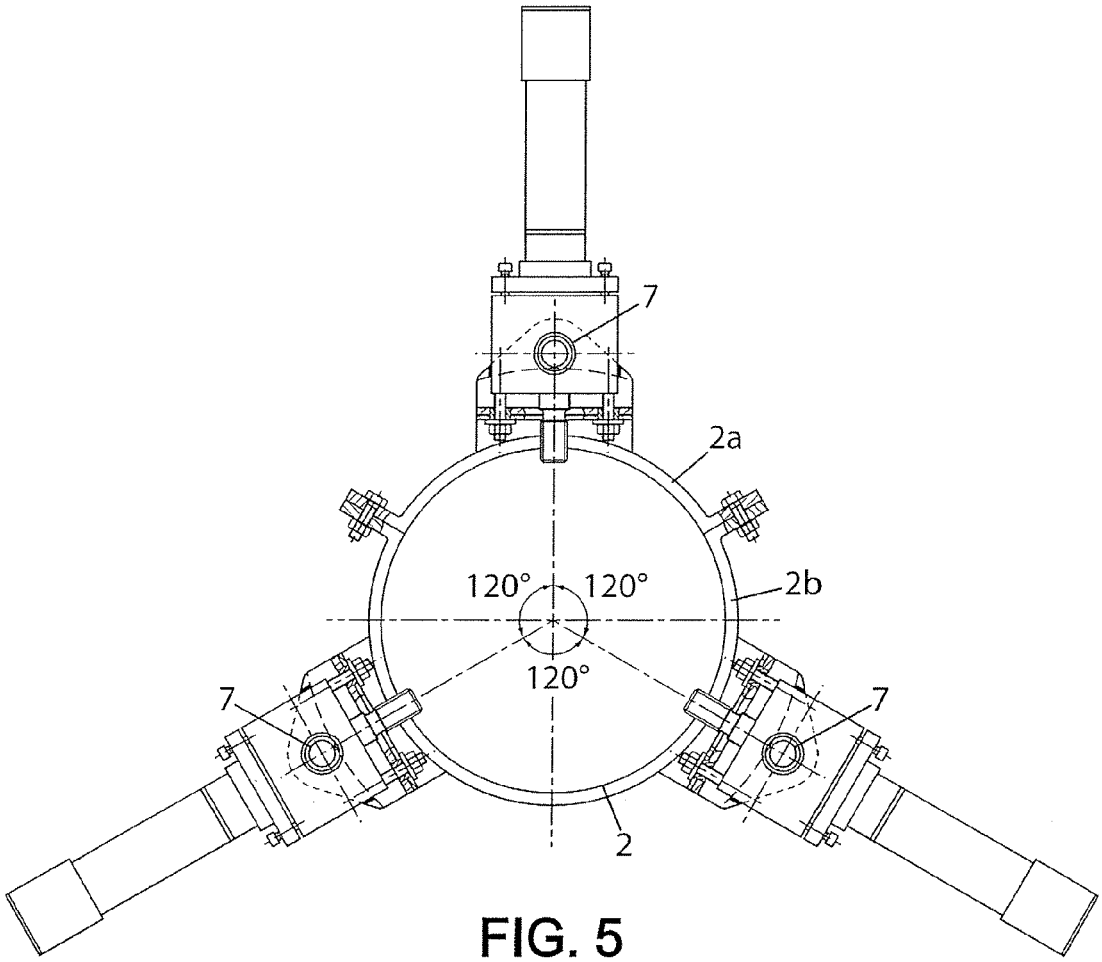
FIG. 5 is a diagram showing an advantageous configuration of a shell according to one embodiment of the invention.

Advantageously, a greater number of piston-type dampers 1 may be used for reasons of strength. Thus, when one piston-type damper is faulty, it can be made up for by the projected component of one or more other piston-type dampers. Nevertheless, the number of piston-type dampers should not be overdone for reasons of economy and bulk. One advantageous embodiment consists in using three piston-type dampers placed around the cable with an angle of 120° between them. This embodiment is illustrated in FIG. 5 (in which the piston-type dampers are not shown, but in which the links 7 between the different piston-type dampers and the shell 2 are apparent).

The linear stroke of the pistons is derived from the amplitude of the vibrations of the cable. The size of the piston-type dampers must therefore be chosen in relation to this amplitude and to the damping law. As an illustration, it is assumed that the length of a piston-type damper is at least three times the stroke travelled. Thus, for strokes of +/−50 mm, or a total of 100 mm, the length of the piston is at least 300 mm.

To damp a considerable portion of the vibrations, it is advantageous for the body of the piston-type dampers to extend beyond the diameter of the anchoring tube 4, without which the latter would have an extremely large diameter. Such an arrangement is shown in particular in FIG. 1. Openings 9 are provided in the shell 2 to allow access to the link 8 and to allow the piston-type dampers to pass through, while allowing the movements of the piston-type dampers in accordance with the links 7 and 8. These openings may for example be oblong holes and they must provide a sufficient clearance so as not to hamper the movements of the piston-type dampers when the cable vibrations occur but also so that maintenance of the internal units can be provided for.

Furthermore, to prevent the presence of such openings 9 in the shell 2 allowing water to penetrate the cable and come into contact with the bundle of metal strands sealing means are advantageously provided. For sealed caps 12 may fully cover the damping 5, example, devices around each of the piston-type dampers 1 used, as shown in FIG. 1, which has the effect of providing sealing at the level of the openings 9. Another sealing system may also be used: it consists skirt connected in a sealed manner on piston-type damper 1 and on the other hand to the shell of a flexible one hand to a 2. In addition, all the mechanical links are preferably designed sealed.

As indicated above, the shell 2 is preferably aligned with the anchoring tube 4 and extended by the sealed sheath 6 protecting the bundle of metal strands 5 in its running portion.

Now, the dampers and the links deteriorate over time which means that they require periodic maintenance or even replacement. In order to avoid dismantling the shell 2, which would involve lifting the sheath 6 with heavy lifting means, the piston-type dampers 1 are advantageously connected to the shell 2 and to the clamping collar 3 without it being necessary to open the shell.

Accordingly, a screw connection may be used. FIG. 1 offers an illustration of such a connection between a piston-type damper 1 and the clamping collar 3. The end of the piston-type damper then consists of a threaded rod that can be screwed into a mount 10 tapped to match, this mount in turn being connected to the balljoint link 8 which connects the collar 3 to the piston-type damper 1.

In this situation, the outer threading of the piston-type damper 1 can be used to adjust the position of the piston-type damper according to the centering level of the bundle of metal strands 5 inside the tube 4 or the shell 2. A locking system to prevent the piston-type damper 1 unscrewing from the mount 10 would advantageously be used to prevent the vibrations of the assembly causing the piston-type damper to unscrew.

Figure 2:
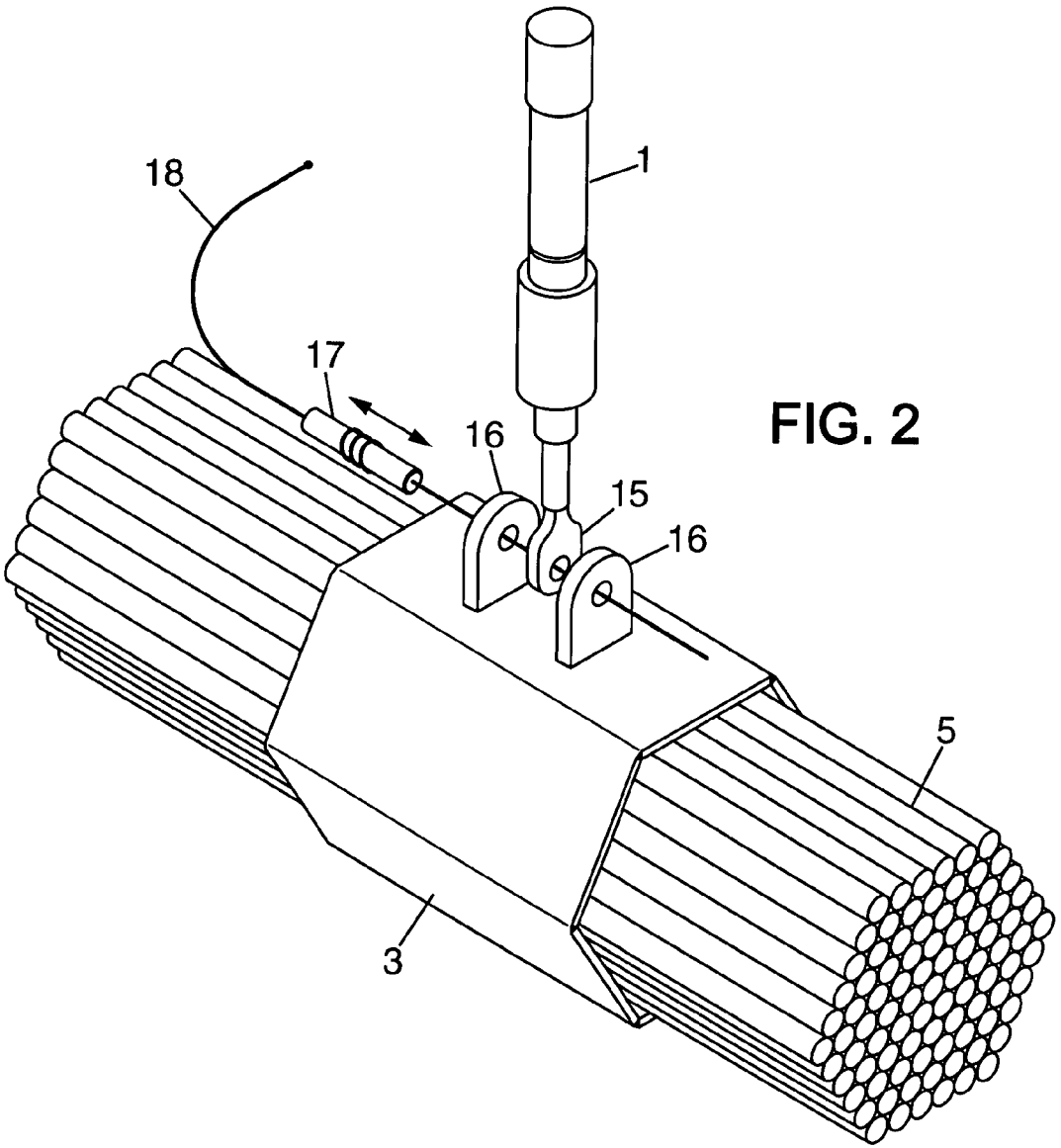
FIG. 2 is, an example of attachment of a piston to a clamping collar according to one embodiment of the invention.

FIG. 2 shows an alternative connection between a piston-type damper 1 and the clamping collar 3. The piston-type damper 1 in effect has at its end a rod furnished with a male clevis 15. In addition, one or more female devises 16 are rigidly connected to the clamping collar 3. The connection between the piston-type damper 1 and the clamping collar 3 then consists in actuating in translation, from the outside of the shell 2, a pin 17 parallel to the cable, via a control means 18, operating for example like a bicycle brake cable. When the means 18 is actuated, the pin 7 is inserted into or extracted from the orifices of the devises 15 and 16, thus providing releasable connection between the piston-type damper 1 and the collar 3.

Since the amplitude of vibration of the stay cannot be predicted with certainty, it may be the amplitude of movement of the using mechanical means independent dampers 1 in order to avoid overdimensioning the stroke of the pistons, but also order to protect them from overloads. In addition, it is worthwhile to be able to alter the damper if the cable is not perfectly anchoring tube due in particular to the tolerances execution of the work.

Figure 3:
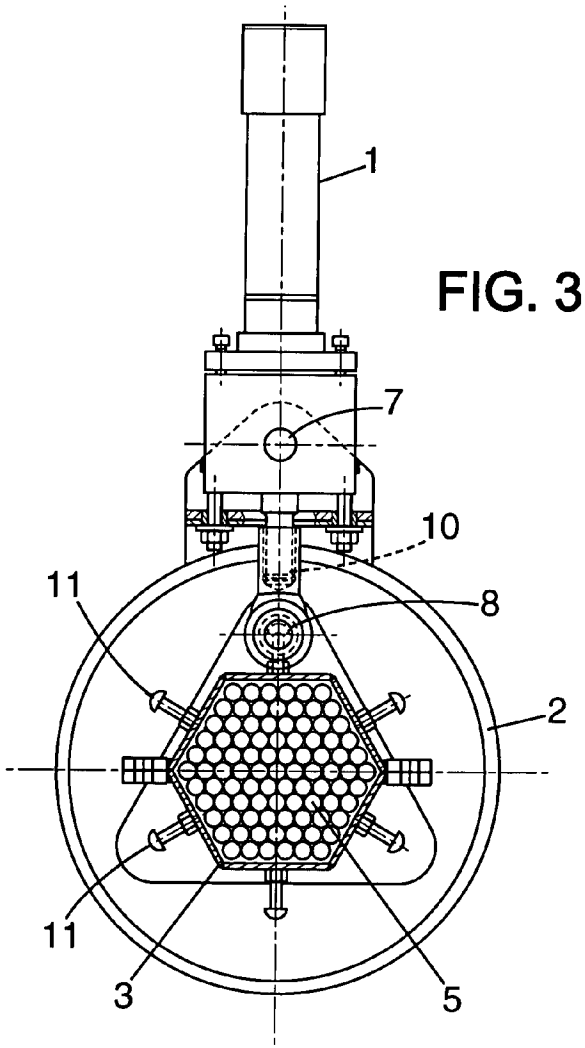
FIG. 3 is a diagram of one embodiment of the invention in cross section.

Accordingly, adjustable stroke limiters may be disposed on the clamping collar 3. FIG. 1 shows an example of such an element 11. In FIG. 3, six screws 11 are disposed on the six external faces of the hexagonal clamping collar 3 to limit the travel of the bundle of strands 5. These screws may be screwed into or out of parts such as nuts welded onto the faces of the clamping collar 3. They are advantageously terminated with a head provided with a shock absorbing material such as rubber for example. They are positioned at a distance from the shell 2 corresponding to the maximum required travel for the bundle of strands 5.

FIG. 3 shows, in cross section, a damper according to the invention, in which a single piston-type damper 1 has been represented for clarity. In this figure, the bundle of metal strands 5 is centred inside the shell 2 which is in line with the anchoring tube 4 and the sheath 6 of the cable. In addition, the piston-type damper is in a radial position relative to the cable. This position corresponds to a position at rest in which no vibration has occurred and therefore in which the damper does not have to attenuate any relative movement of the bundle of strands 5 with respect to the shell 2, that is to say relative to the structure to which the shell is secured.

Figure 4:
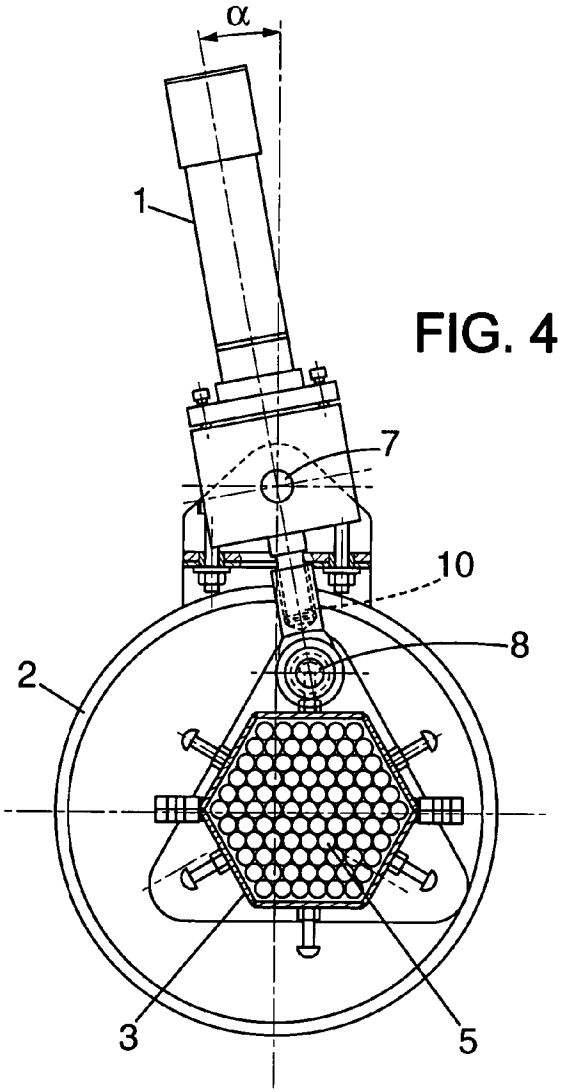
FIG. 4 illustrates in cross section a movement of a piston during a damping of vibrations of the cable.

For its part, FIG. 4 shows the same device as FIG. 3. However, in this figure, it appears that the bundle of metal strands 5 has undergone a relative movement with respect to the shell, due to vibrations of cable. The bundle of strands 5 thus moves until collar 3, at the maximum, makes contact with the shell 2 (or until a travel limiter 11 makes contact with the shell). The movement of the bundle of strands 5 is attenuated by the action of the piston-type damper 1 which moves thanks to its ball-joint link 8 with the clamping collar 3 and its pivot link 7 with the shell 2. In the example illustrated in FIG. 4, the movement of the piston-type damper 1 is such that the latter is a position offset at an angle a from its radial, at the rest position. Naturally, when several piston-type dampers are used, which is usually the case in the present invention, each piston-type damper experiences an individual movement in conformity with the links that it has with the clamping collar 3 and the shell 2. Each movement of the bundle of strands 5 is then reflected in a simultaneous action of each piston-type damper in directions corresponding to respective components of the general direction of movement of the bundle 5.

FIG. 5 shows an advantageous embodiment of the invention in which three piston-type dampers (not shown) are connected to the shell 2, evenly spaced so that their respective axes form, two by two, an angle of 1200.

In addition, the shell 2 in FIG. 5 consists of two distinct portions 2*a* and 2*b*, the two portions of shell being connected together for example by means of screws. Such a shell has the advantage of being easy to attach around the bundle of strands 5 and also being easy to remove.

The invention claimed is:

1. A device for damping the vibrations of a cable used in the structure of a construction work, the cable comprising a bundle of metal strands having ends anchored to the work and being surrounded, in at least one region adjacent to an anchored end of the bundle, by a tube connected to the work, the device comprising a collar for placement around the bundle of strands and means for absorbing vibration energy, said means for absorbing mounted to the collar and mountable to the tube, wherein the means for absorbing comprise at least two dampers, each damper having a substantially linear stroke, said dampers placeable substantially radially relative to a cable and distributed at angles around a cable, each damper having a first link articulated with the collar and a second link articulated with a support secureable to the tube.

2. A device according to claim 1, in which the said support securable to the tube is placeable substantially in an extension of the tube, or is combinable as part of the said tube.

3. A device according to claim 1, in which the said support securable to the tube is placeable substantially in an extension of a sleeve surrounding the bundle of metal strands of the cable.

4. A device according to claim 1, in which the support securable to the tube comprises at least two portions suitable for being attached together.

5. A device according to claim 1, in which the means for absorbing comprise two dampers substantially perpendicular to each other.

6. A device according to claim 1, in which the means for absorbing comprise at least three dampers distributed evenly at angles.

7. A device according to claim 1, in which the said first link is a ball-joint link, for at least one of the dampers.

8. A device according to claim 1, in which the said second link is a ball-joint link, for at least one of the dampers.

9. A device according to claim 1, in which the said second link is a pivot link positionable parallel to a cable, for at least one of the dampers.

10. A device according to claim 1, in which at least one of the dampers extends partially beyond the support secured to the tube, and in which respective openings are provided in the support for access to the first link of the said dampers.

11. A device according to claim 10, including sealing means to seal at least one space situated between the said dampers and the respective openings in the support.

12. A device according to claim 1, in which the first link articulated with the collar comprises, for at least one of the dampers, means of screwing a threaded end of the dampers into respective mounts.

13. A device according to claim 12, in which the screwing means are adjustable to adapt the position of the dampers to a centering level of the bundle of metal strands in the tube.

14. A device according to claim 12, in which the first link articulated with the collar also comprises, for the said dampers, locking means suitable for preventing the threaded end of the dampers from unscrewing from the corresponding mounts.

15. A device according to claim 1, in which one end of at least one of the dampers is provided with a male clevis, in which at least one corresponding female clevis is attached to the collar, and in which the first link articulated with the collar comprises, for the said dampers, means of inserting a pin into the male clevis of the piston and into the corresponding female clevis, the said means of inserting a pin being able to be actuated from outside the tube.

16. A device according to claim 1, furthermore comprising means for adjustably limiting the stroke of at least one of the piston.

17. A device according to claim 16, in which the means for limiting the stroke of said piston comprises a screw suitable for being screwed into or out of welded elements distributed over a surface of the collar, the screw also comprising a head provided with a material suitable for absorbing shocks.

18. A device according to claim 1 wherein at least one of said dampers is a piston damper.

19. A device according to claim 1 wherein said dampers comprise piston dampers.

20. A device according to claim 19 wherein said dampers are distributed at substantially equal angles from each other.

* * * * *